US009192243B2

(12) United States Patent
Slaughter

(10) Patent No.: US 9,192,243 B2
(45) Date of Patent: Nov. 24, 2015

(54) LIGHTED MULTI-PLANE WINDOW WELL ENHANCEMENT SYSTEM

(76) Inventor: Sharon Slaughter, Aurora, CO (US)

( * ) Notice: Subject to any disclaimer, the term of this patent is extended or adjusted under 35 U.S.C. 154(b) by 652 days.

(21) Appl. No.: 13/474,710

(22) Filed: May 17, 2012

(65) Prior Publication Data

US 2012/0294010 A1 Nov. 22, 2012

Related U.S. Application Data

(60) Provisional application No. 61/519,144, filed on May 17, 2011.

(51) Int. Cl.

| | |
|---|---|
| ***F21V 13/02*** | (2006.01) |
| ***F21V 1/00*** | (2006.01) |
| ***A47C 21/00*** | (2006.01) |
| ***F21V 33/00*** | (2006.01) |
| ***F21V 17/00*** | (2006.01) |
| ***G09F 13/20*** | (2006.01) |
| ***G09F 13/08*** | (2006.01) |
| ***G09F 13/16*** | (2006.01) |
| ***E06B 7/28*** | (2006.01) |
| ***E06B 9/24*** | (2006.01) |
| *F21W 121/00* | (2006.01) |
| *F21W 131/10* | (2006.01) |

(52) U.S. Cl.

CPC ..... *A47C 21/003* (2013.01); *E06B 7/28* (2013.01); *E06B 9/24* (2013.01); *F21V 17/002* (2013.01); *F21V 33/006* (2013.01); *F21V 33/0012* (2013.01); *F21V 33/0016* (2013.01); *G09F 13/08* (2013.01); *G09F 13/16* (2013.01); *G09F 13/20* (2013.01); *E06B 2009/247* (2013.01); *E06B 2009/2417* (2013.01); *E06B 2009/2447* (2013.01); *F21W 2121/00* (2013.01); *F21W 2131/10* (2013.01)

(58) Field of Classification Search

CPC ..... A47C 21/003; E06B 9/24; E06B 7/28; G09F 13/08; G09F 13/16; G09F 13/20; F21V 17/002; F21V 33/0016; F21V 33/006; F21V 33/0012

USPC ..... 362/629, 129, 130, 131, 615

See application file for complete search history.

(56) References Cited

U.S. PATENT DOCUMENTS

| | | | | |
|---|---|---|---|---|
| 5,799,165 | A * | 8/1998 | Favor et al. | 712/214 |
| 8,668,372 | B2 * | 3/2014 | Duerksen et al. | 362/629 |
| 2009/0033648 | A1 * | 2/2009 | Podd et al. | 345/211 |
| 2010/0319227 | A1 * | 12/2010 | Sanders | 40/546 |

* cited by examiner

*Primary Examiner* — Joseph L Williams

(57) ABSTRACT

The invention utilizes a number of thin, flexible layers placed in parallel to each other and the back wall of a window well. The inner layer is translucent such that when lit, the lighting shines through the layer and illuminates the middle and outer layers or shines through all the layers and through the window well and into the room. Alternatively, the inner layer is reflective so that it reflects light directed towards it into the other layers. The various layers can be variably transparent, translucent and/or opaque and can be shaded. By spacing the layers apart, depth can be imparted to a viewer. The outermost layer can have the appearance of a metallic film and/or artistic representations. This outer film can be stenciled such that patterns of light shine through in various places.

6 Claims, 4 Drawing Sheets

LIGHTED MULTI-PLANE WINDOW WELL ENHANCEMENT SYSTEM

CROSS-REFERENCE TO RELATED APPLICATIONS

This application claims the benefit of U.S. Provisional Application No. 61/519,144 entitled LIGHTED MULTI-PLANE WINDOW WELL ENHANCEMENT SYSTEM and filed on May 17, 2011 which is specifically incorporated by reference herein for all that it discloses and teaches.

TECHNICAL FIELD

The invention relates generally to window wells, and more particularly to a lighted multi-plane window well enhancement system.

BACKGROUND

There are many types and styles of window wells used in both residential and commercial construction. They are commonly employed when a basement or first floor room has windows that are partially below grade (i.e., the dirt or ground level outside the window is above the bottom of the window itself). This occurs most often because of drainage issues—the ground level must be sloped away from the building in order to ensure that rain and other moisture is not directed towards the building but instead flows away from it. Most building codes require approximately six inches of clearance between the bottom of a window and the grade. If this minimum isn't met, a window well can be employed to keep the soil back, away from the window. Window wells ensure that outside light and ventilation can reach the window while allowing the window to open so that occupants of the room can exit the building through the window in case of fire, etc.

Window wells are usually constructed using galvanized steel, concrete block, or other materials which lack visual appeal. They are not designed to be pleasing to the eye, but are instead functional objects which work like a dam to hold soil away from a window that is located at least partially below grade. Nevertheless, when occupants of a room look out a window that has a window well, they view only the raw galvanized steel, concrete block, or other window-well material. Because of this lack of visual appeal, various efforts have been made to cover the window well material or otherwise beautify it. However, care must be taken when undertaking such efforts as objects which block or otherwise obstruct egress through the window well can be a dangerous violation of fire codes. Additionally, the bottom of a window well must not be obstructed as water enters the window well and must be able to drain away. Furthermore, because window wells are at ground level, they can provide an easy means of ingress into a building. Obviously, security and safety concerns then arise, and so there are many devices that are designed to secure the window well against unauthorized entry into a building. It is important that any beautification efforts do not thwart the functionality of such devices or impede their installation.

Therefore, what is needed is a decorative or eye-pleasing enhancement system that can be added to existing window wells or incorporated into the installation of new window wells. Such a system must be thin so that it does not inhibit egress through the window well and yet it must be durable to withstand the deleterious effects of wind, rain, sunlight, etc. The system must not obstruct the bottom of the window well such that water drainage remains unimpeded. Additionally, the system should be modular so that components can be removed for cleaning, replacement, customization, and to allow the user to modify the artistic and decorative aspects to suit their current interior decorating motif or seasonal decorations. Furthermore, it must be able to be installed without inhibiting the installation and functionality of security measures designed to keep intruders from using the window well as a means of entering the building.

SUMMARY

One embodiment of the present invention utilizes a number of thin layers of flexible material(s). The materials can be any relatively thin, flexible material that can be cut and shaped as described below. One exemplary material is polycarbonate resin thermoplastic (e.g., Lexan®). Layers of Lexan® can be cut and shaped to the desired dimensions (approximately the same size as the back wall of the window well) and can then be laminated together into a semi-rigid layered material. Multiple such configurations could be employed; alternatively, individual layers of Lexan® could be employed instead. In either case, the layers are placed approximately in parallel to each other and the back wall of a window well. The inner layer, the one closest to the back wall of the window well, can be transparent or translucent such that when LED lighting (or other type of lighting) is attached thereto, the lighting shines through the layer and illuminates the outer layers or shines through all the layers and through the window well and into the interior space. In another embodiment, the inner layer is reflective (e.g., a bright white color) so that it reflects light directed towards it into the other layers. The various layers can be transparent, translucent or opaque and can be shaded so as to color or shade any transmitted or reflected light. Ideally, two to three layers are utilized: a generally translucent (or reflective) inner layer, a middle layer (optional, but if present, usually colored/shaded), and a viewable outer layer. By spacing the layers approximately one-half to one inch apart (in other embodiments other spacing distances are used), a feeling of depth can be imparted to someone viewing the system from the interior. The layers can be clipped to the top and/or bottom edges of the rear wall of the window well and can be installed from above or from inside the window well.

In one embodiment, the outermost layer can have the appearance of a metallic film. It can comprise a lightweight contact paper that is an adhesive film. Such films are commonly used in printed outdoor signage. This outer film can have shapes cut from it (similar to stenciling) such that patterns of light shine through in various places. In addition, the outer layer can be constructed using a material that has a plurality of small perforations to let light through. A structural under layer can be employed to give form and strength to this outer layer.

DETAILED DESCRIPTION

Figure 1:
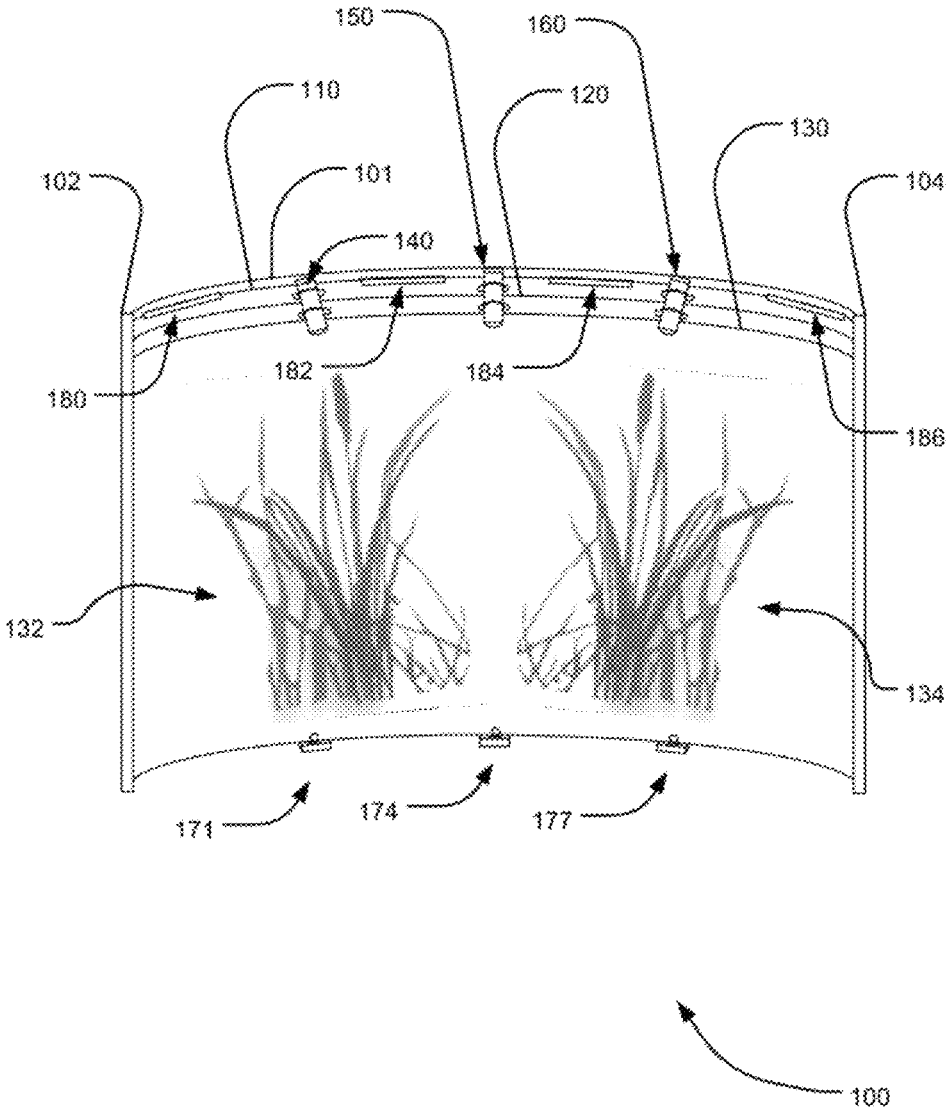
FIG. 1 shows a perspective front view of an exemplary embodiment of a lighted multi-plane window well enhancement system.

FIG. 1 shows a perspective front view of an exemplary embodiment of a lighted multi-plane window well enhancement system 100 installed in a window well. When a person looks through a window frame having a multi-plane window well enhancement system 100 installed, instead of seeing detritus, rust, etc., the person sees a much more pleasant vista. The back wall of the window well 101 is no longer visible and is instead replaced by an artistic outer layer 130 having a plurality of artistic representations 132 and 134 that can be backlit by an eye-pleasing inner layer 110. The outer layer 130 shown in FIG. 1 is a mostly opaque artistic representation 132 and 134 that is meant to be eye-catching and visually interesting. Because of the multi-layered nature of the system 100, the design appears to be three-dimensional.

The layers of the system 100 can comprise any material that is relatively thin and flexible. In one embodiment, the system 100 employs sign film that is laminated to polycarbonate sheet. A material such as Lexan® has appropriate properties for the supporting polycarbonate sheet material. Lexan® can also be finished and colored in other ways besides through the application of a film on its outer surface. For example, the outer surface can be digitally printed, painted, silkscreened, etc. In another embodiment, durable and flexible materials other than film can be applied to the outer surface of the relatively thin and flexible outer layer 130 of the system 100. Examples of such materials include fabrics meant for outdoor use (such as banner material or materials like Sunbrella®, which is used for patio umbrellas and boat canopies, etc.). Furthermore, because such materials often possess substantial rigidity and structural strength in their own right, a supporting layer of polycarbonate sheet or Lexan® may not be necessary.

In the exemplary embodiment shown in FIG. 1, the inner layer 110 is lit by a soft light from the plurality of lights 180, 182, 184, and 186. The plurality of lights 180, 182, 184, and 186 are positioned in the embodiment in FIG. 1 to shine downwards from above onto a reflective inner layer 110. The light is then reflected outwards through the middle layer 120 and outer layer 130. In another embodiment, the lights are positioned behind the inner layer 110 and the inner layer 110 is translucent. The translucent nature of the inner layer 110 allows the light to be transmitted at various intensities through the inner layer 110. If, instead, the lighting components 180, 182, 184, and 186 are installed at the base of the lighted multi-plane window well enhancement system 100, then the bottom portions are more brightly lit than the upper portions. Other lighting configurations are contemplated.

The lighting components 180, 182, 184, and 186 can comprise any number of currently known lighting means. In one embodiment, a strip of LED lights are placed behind the multi-plane layers and are directed to shine up and through the layers. The lighting component can be customized such that it is dimmable, programmable, etc. For example, a lighting control module can be employed that automatically dims the lighting during certain time periods (for example, late at night) and/or turns it off completely (for example, during the work-day hours), etc. Furthermore, the lighting system can employ colored lights that can be selected by the user or through an automated control module. Patterns, randomization, pulsing, flashing, color-changes, movement, etc. can be employed.

In addition to replacing the unpleasant view of the back wall 101 of the window well, the system 100 can also incorporate eye-pleasing floor features positioned near the floor of the window well. Such features can include colored, tumbled glass or similar materials which would add beauty to the window well while not interfering with the drainage function of the existing gravel base. Such added features could also be enhanced by a dedicated lighting device.

The left side wall 102 of the system 100 is shown in FIG. 1 as is the right side wall 104. These walls serve as first and second end attachments, respectively, for the layers 110, 120, and 130 of the system 100. In one embodiment, the walls are attached to the exterior wall of the building at approximately the point where the back wall 101 of the window well attaches thereto.

The plurality of hanging apparatuses 140, 150, and 160 are shown in FIG. 1. The hangers 140, 150, and 160 support the layers 110, 120, and 130 and keep them properly spaced in order to impart the three-dimensional appearance. The bottom brackets 171, 174, and 177 perform a similar spacing function and serve to secure the layers 110, 120 and 130. As shown in FIG. 1, the bottom brackets 171, 174 and 177 utilize a paper-clip style attachment to clip the brackets to the layers. Other attachment means are contemplated. Additionally, in some embodiments, bottom brackets are not utilized.

The exemplary embodiment of the layers shown in FIG. 1 can comprise a lighted multi-plane window well enhancement system. Three layers are shown: an inner reflective layer 110, a translucent middle layer 120 and an outer design layer 130; in other embodiments, the number of layers can vary. In the embodiment illustrated in FIG. 1, the outer layer 130 is depicted as being an opaque, silver metallic film that is cut and laminated over a clear polycarbonate sheet to give it structure and rigidity. The inner layer 110 is depicted as being a reflective white color, that allows the lights to shine down onto it and be reflected outwards through the middle layer 120 and out of the outer layer 130. In other embodiments the inner, middle and outer layers 110, 120, and 130 can be configured differently, having different colors, shapes, etc.

The lighting component 180, 182, 184, and 186 can comprise conventional incandescent lights, LED lights, fluorescents lights, laser lights, or any other type of lights. In one embodiment, a strip of LED lights are attached near the bottom of the inner layer 110 using a self-adhesive strip or a series of clips. The lights can be configured to point upwards and shine through the inner layer 110 and onto and through the open spaces in the outer layer 130. The lighting may be dimmable, programmable for color, brightness, time of day, etc. and can be controlled by a wired or wireless controller that can be situated inside the room to which the window well is attached so that the lighting can be controlled without having to open the window or go outside. Additionally, the lights can incorporate movement, music, and any other known "light-show" components as requested by the user.

As discussed above, the layers 110, 120 and 130 can be modular so that they can be individually removed for cleaning or to clean the space between them. Further, other system components are also modular so that the user can replace the lighting, layers, etc. in order to change the color and design elements of the window well enhancement system as desired. In one embodiment, a middle layer is removed. By spacing the layers and incorporating cut-outs/stencils, a three-dimensional appearance is created that gives the viewer a sense of depth.

As discussed above, the materials that can be used to construct the layers are varied. In one embodiment, high-performance vinyl is cut and shaped using cutters/plotters, in another embodiment, graphics and other items can be printed on banner materials and then applied to a structural sheet that provides rigidity. As another example, a two-part film/carrier medium can be employed that utilizes a top surface film that comes on a carrier having a built-in adhesive. Once the desired pattern has been cut or the desired scene has been printed, the backing can be removed to expose the built-in adhesive. The film is then applied to a structural sheet and a squeegee or similar device is used to remove air-bubbles and smooth the film (this is similar to the application of window tinting film). In another embodiment, the translucent middle layer can be a frosted, colored, or painted/air-brushed Lexan® or other polycarbonate-like material.

Figure 2:
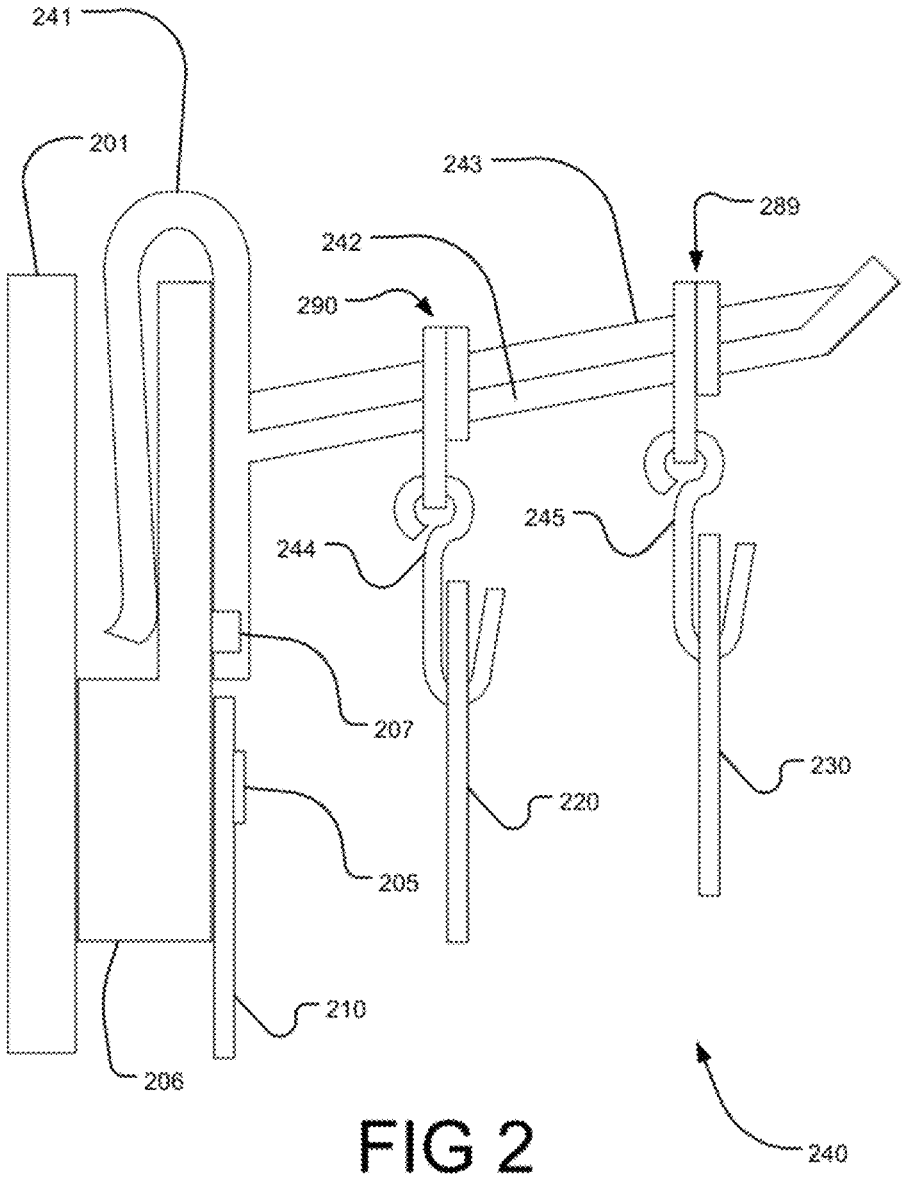
FIG. 2 illustrates a side elevation view of an exemplary embodiment of a lighted multi-plane window well enhancement system highlighting the support member and hanging apparatus.

FIG. 2 illustrates a side elevation view of an exemplary embodiment of a lighted multi-plane window well enhancement system highlighting the support member 206 and hanging apparatus 240. The back wall 201 of the window well is shown for reference. The support member 206 is attached to the window well and provides a solid anchor point for the hanging apparatus 240. A pressure clip 241 is shown in FIG. 2 as a possible embodiment for the attachment means between the hanger bar 242 and the support member 206. Other types of attachment means are contemplated. The lower portion of the hanging apparatus 240 abuts a twist stop 207, for more details see FIG. 3.

The hanger bar 242 attaches to a layer 220 of the system via a bar clip 290. A second bar clip 289 is also shown. The bar clip 290 attaches to the hanger bar 242 and provides a location for a hanger hook 244 to be suspended therefrom. The hanger hook 244 can attach to a layer with adhesives, screws, hook-and-loop materials, or by any other suitable attachment means. In the embodiment shown in FIG. 2, the hanger hook 244 has a U-shaped hook which is placed through a corresponding hole in the middle layer 220 so that the layer 220 can hang suspended from the hanger hook 244. The outer layer 230 can similarly hang suspended from the second hanger hook 245. The hanger hooks 244 and 245 can simply hang from the bar clips 290 and 289 or they can snap-in or otherwise be attached to the bar clips 290 and 289.

The hanger bar 242 is shown in FIG. 2 with a structural support 243. This support 243 allows the hanger bar 242 itself to be made lighter or out of less expensive materials; it is optional in other embodiments.

The inner layer 210 is shown in FIG. 2 attached near the lower end of the support member 206. The inner layer attachment 205 illustrated in FIG. 2 is a push-in rivet. Other attachments are contemplated. In another embodiment, a support member 206 is unnecessary as the hanger bar 242 can attach directly to the back wall 201 of the window well. However the hanger bar 242 is supported, it is positioned such that it extends outwards over the window well and provides an approximately horizontal surface from which to hang layers. Similarly, the inner layer 210 can be suspended from the hanger bar 242 instead of being attached to the support member 206 or directly to the back wall 201 of the window well.

The horizontal protrusion of the hanger bar 242 provides a continuous surface from which to hang the layers 210, 220, and 230. Thus, the layers 210, 220 and 230 can be adjusted closer to and further from the back wall 201 of the window well as desired. The bar clips 290 and 289 can be manipulated so that they slide up and down the hanger bar 242 and lock into place once they are positioned as desired. As noted above, other embodiments can have fewer or more layers, necessitating fewer or more fastener bar clips be added to the hanger bars. The means of fastening the layers to the bar clips can vary from the hanger hooks 244 and 245 and can include, for example, snaps, hook-and-loop material, buttons, magnets, or any other suitable means that allows for removal and customization of the layers.

Figure 3:
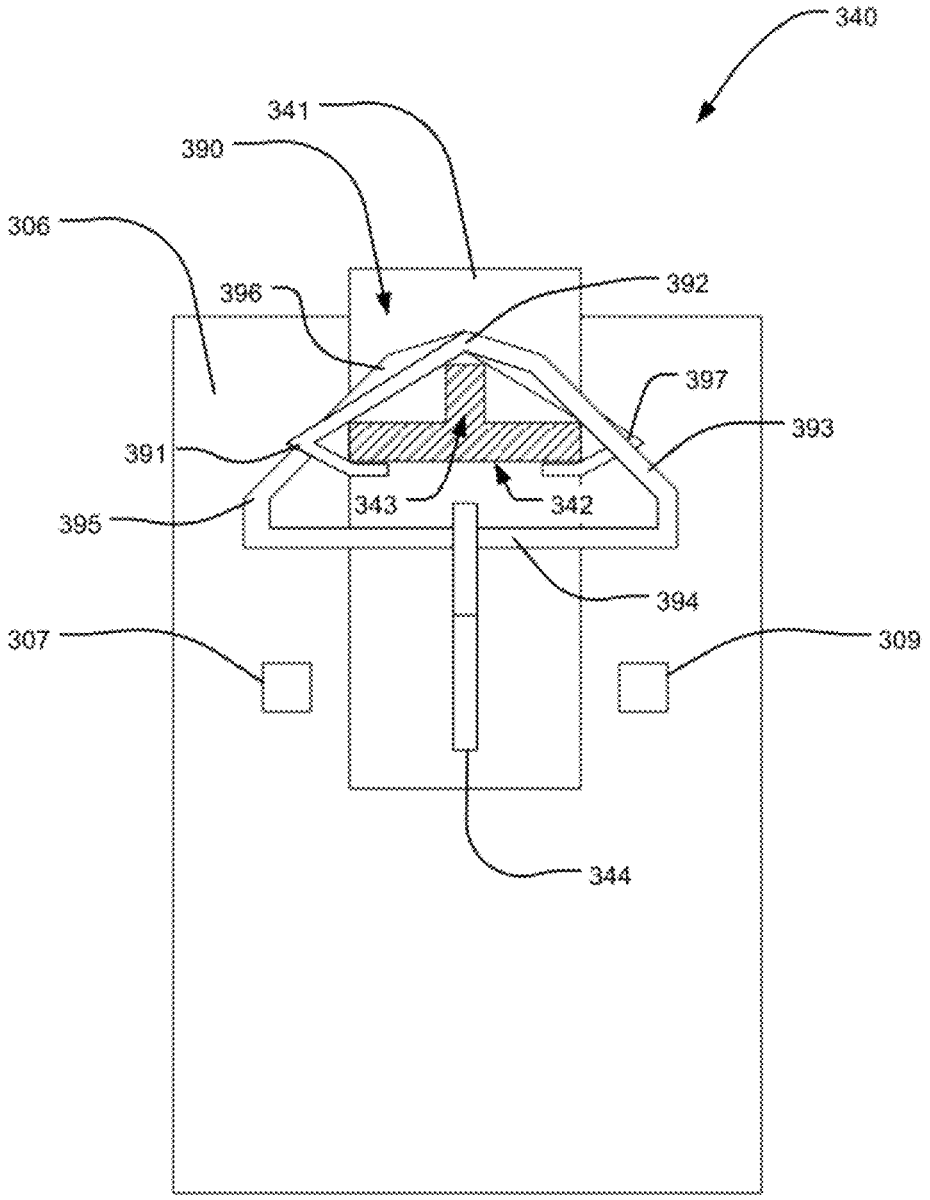
FIG. 3 illustrates a front elevation view of an exemplary embodiment of a lighted multi-plane window well enhancement system highlighting the support member and hanging apparatus.

FIG. 3 illustrates a front elevation view of an exemplary embodiment of a lighted multi-plane window well enhancement system highlighting the support member 306 and hanging apparatus 340. The hanger bar 342 is shown in cross-section as is the structural support 343. This allows for the shape and nature of the bar clip 390 to be illustrated. The bar clip 390 begins with the left hook 391 which holds the bar clip 390 to the left side of the hanger bar 342. The left top 392 of the bar clip 390 extends above the structural support 343 and connects to the right extension 393 of the bar clip 390. The right extension 393 attaches to the bottom spar 394 which provides the attachment means for the hanger hook 344. The bottom spar 394 then attaches to the left extension 395 which brings the clip 390 back around the hanger bar 342. The left extension 395 connects to the right top 396 which extends over the structural support 343 and connects to the right hook 397 which holds the bar clip 390 to the right side of the hanger bar 342. The above described arrangement for the bar clip 390 allows the clip 390 to grip the hanger bar 342 tightly when in its desired position and yet through a simple squeezing manipulation, the left hook 391 and right hook 397 release the hanger bar 342 and the entire bar clip 390 can be slid along the hanger bar to a new desired position.

The hanger hook 344 is shown in FIG. 3 as hanging from the bottom spar 394 of the bar clip 390. The hanger hook 344 can slide back and forth in response to wind, user manipulation, etc. as needed. Also shown in FIG. 3 are the first and second twist stops 307 and 309. These are protrusions on the support member 306 that ensure the hanging apparatus 340 can not twist too far in either direction do to external pressures (such as wind).

Figure 4A:
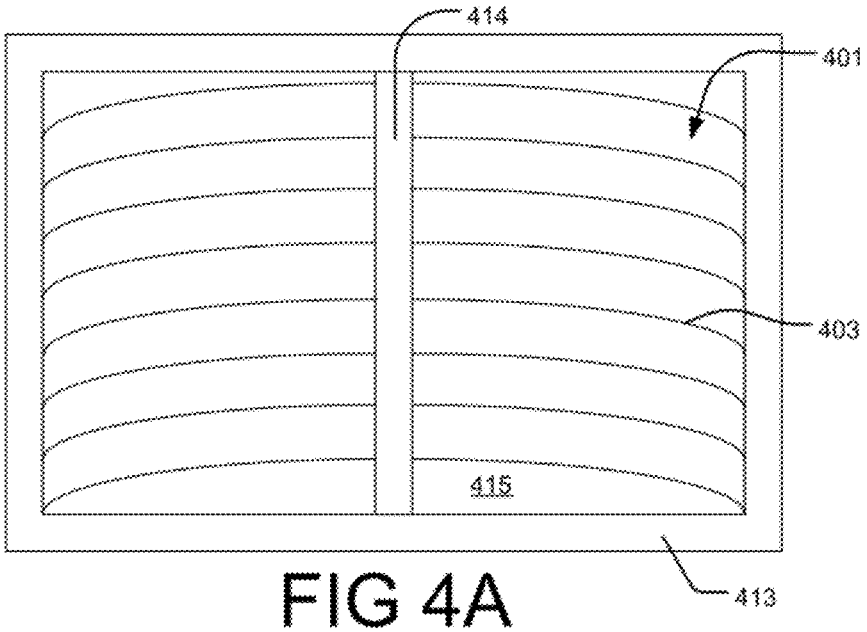
FIG. 4A illustrates a front view of an exemplary embodiment of a window well prior to installation of the system.

FIG. 4A illustrates a front view of an exemplary embodiment of a window well prior to installation of the system. The window frame 413 is illustrated as is a middle upright 414 of the frame. The floor 415 of the window well is shown as is the back wall 401. The plurality of corrugations 403 are illustrated as this is a common and visually unappealing feature of many window wells. Such window wells typically become unsightly, having rust stains and otherwise unpleasant features. Further, the window well often collects detritus such as sticks, leaves, and other unsightly debris on the floor 415 of the window well.

Figure 4B:
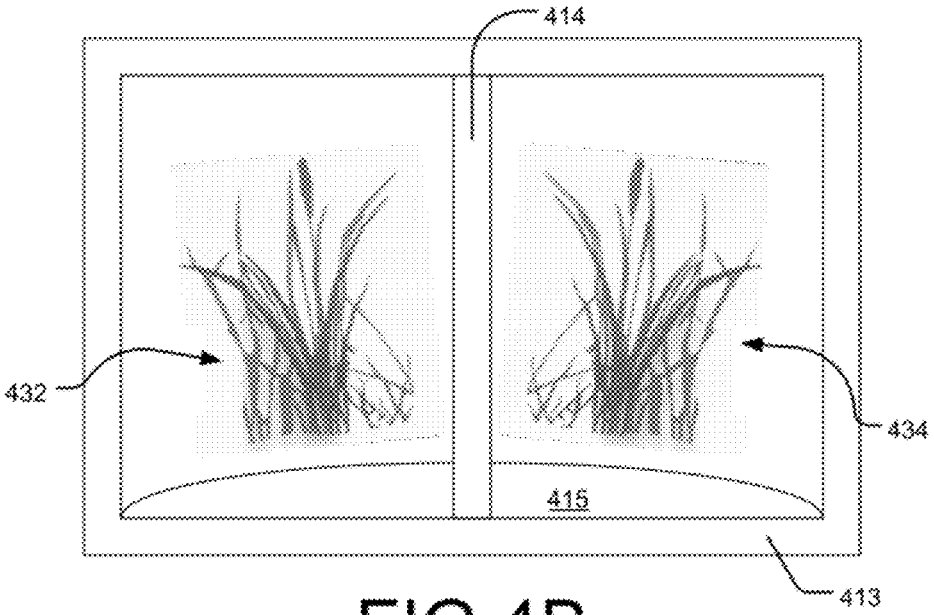
FIG. 4B illustrates a front view of an exemplary embodiment of a window well after installation of a lighted multi-plane window well enhancement system.

FIG. 4B illustrates a front view of an exemplary embodiment of a window well after installation of a lighted multi-plane window well enhancement system. As illustrated in FIG. 4B, when viewed from the interior of the room, the window well is surrounded by the window frame 413 and 414. A person positioned in the room can no longer view the rust, detritus and other generally unpleasant aspects of typical window wells when looking out through the window frame. Instead, the viewer sees the outer layer of the system as well as the lights and three-dimensional appearance caused by the translucent, reflective, transparent, and/or opaque portions of the layers.

In addition to being employed in window wells, the described enhancement system can also be customized to hide foundation walls, soffits (interior and exterior), and unsightly walls or windows having poor views. The system can also be used as a portable room divider to carve out private spaces in lofts or other large rooms, offices, etc. The system can be configured to hang from a wall as wall art and can be used in children's rooms as lighted, dimmable art having various childhood themes such as nursery rhymes, cartoons, etc. Additional configurations include: as lighted furniture components (such as a headboard for a bed), replacing/enhancing sconces and lamps, as artistic pieces on decks/patios or other outdoor locations, as party/wedding/event decorations, enhancing bollards and monuments, as fireplace surrounds, as under-cabinet wall/lighting in kitchens, etc.

While particular embodiments of the invention have been described and disclosed in the present application, it should be understood that any number of permutations, modifications, or embodiments may be made without departing from the spirit and scope of this invention. Accordingly, it is not the intention of this application to limit this invention in any way except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

In light of the above "Detailed Description," the Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The above specification, examples and data provide a description of the structure and use of exemplary implementations of the described articles of manufacture and methods. It is important to note that many implementations can be made without departing from the spirit and scope of the invention.

What is claimed is:

1. A lighted, multi-plane window well enhancement system, comprising:

a translucent inner layer that allows at least some light to be transmitted therethrough;

an outer layer that allows at least some light to be transmitted therethrough;

a lighting component that shines light through the inner layer and the outer layer;

an attachment means for attaching the inner layer and the outer layer to a window well wherein the attachment means is configured to secure the inner layer in proximity to a back wall of the window well and to secure the outer layer between the inner layer and a window.

2. The system of claim 1, wherein the attachment means comprises:

a hanger bar that is attached to the back wall and extends outwards into the window well;

a plurality of bar clips that removably attach to the hanger bar and can be slid thereon and locked into place;

a plurality of hanger hooks that are suspended from the plurality of bar clips and attach to the outer layer.

3. A lighted, multi-plane window well enhancement system, comprising:

a reflective inner layer that reflects at least some light that is directed thereto;

an outer layer that allows at least some light to be transmitted therethrough;

a lighting component that shines light onto the inner layer, the light then reflects off the inner layer and through the outer layer;

an attachment means for attaching the inner layer and the outer layer to a window well wherein the attachment means is configured to secure the inner layer in proximity to a back wall of the window well and to secure the outer layer between the inner layer and a window.

4. The system of claim 3, wherein the attachment means comprises:

a hanger bar that is attached to the back wall and extends outwards into the window well;

a plurality of bar clips that removably attach to the hanger bar and can be slid thereon and locked into place;

a plurality of hanger hooks that are suspended from the plurality of bar clips and attach to the outer layer.

5. A lighted, multi-plane window well enhancement system, comprising:

a reflective inner layer that reflects at least some light that is directed thereto;

a middle layer that is translucent and allows at least some light to be transmitted therethrough;

an outer layer that allows at least some light to be transmitted therethrough;

a lighting component that shines light onto the inner layer, the light then reflects off the inner layer, through the middle layer, and onto and through the outer layer;

an attachment means for attaching the inner layer, middle layer, and outer layer to a window well wherein the attachment means is configured to secure the inner layer in proximity to a back wall of the window well, to secure the outer layer between the inner layer and a window, and to secure the middle layer between the inner layer and the outer layer.

6. The system of claim 5, wherein the attachment means comprises:

a hanger bar that is attached to the back wall and extends outwards into the window well;

a plurality of bar clips that removably attach to the hanger bar and can be slid thereon and locked into place;

a plurality of hanger hooks that are suspended from the plurality of bar clips and can attach to the middle layer and to the outer layer.

* * * * *